US009188912B2

(12) United States Patent
Hasegawa

(10) Patent No.: US 9,188,912 B2
(45) Date of Patent: Nov. 17, 2015

(54) SHEET GUIDING UNIT SEPARATING MECHANISM, FIXING DEVICE WITH SHEET GUIDING UNIT SEPARATING MECHANISM, AND IMAGE FORMING APPARATUS WITH FIXING DEVICE WITH SHEET GUIDING UNIT SEPARATING MECHANISM

(71) Applicant: Kenichi Hasegawa, Kanagawa (JP)

(72) Inventor: Kenichi Hasegawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 19 days.

(21) Appl. No.: 14/134,817

(22) Filed: Dec. 19, 2013

(65) Prior Publication Data

US 2014/0193180 A1 Jul. 10, 2014

(30) Foreign Application Priority Data

Jan. 8, 2013 (JP) ..... 2013-000857

(51) Int. Cl.
*G03G 15/20* (2006.01)

(52) U.S. Cl.
CPC ..... *G03G 15/2028* (2013.01); *G03G 15/2085* (2013.01); *G03G 2215/2032* (2013.01)

(58) Field of Classification Search
CPC ..... G03G 15/2028; G03G 15/2085
USPC ..... 399/323
See application file for complete search history.

(56) References Cited

U.S. PATENT DOCUMENTS

| | | | | |
|---|---|---|---|---|
| 2002/0025204 | A1* | 2/2002 | Ando et al. | 399/381 |
| 2005/0276638 | A1 | 12/2005 | Yamada | |
| 2007/0047984 | A1* | 3/2007 | Sanekata et al. | 399/33 |
| 2012/0044516 | A1 | 2/2012 | Hirose et al. | |

FOREIGN PATENT DOCUMENTS

| | | |
|---|---|---|
| JP | 4-184459 | 7/1992 |
| JP | 2005-352382 | 12/2005 |
| JP | 2012-063742 | 3/2012 |

* cited by examiner

*Primary Examiner* — David Gray
*Assistant Examiner* — Thomas Giampaolo, III
(74) *Attorney, Agent, or Firm* — Harness, Dickey & Pierce, P.L.C.

(57) ABSTRACT

A sheet guiding unit separating mechanism includes a pair of first and second sheet guiding units disposed facing first and second sides of a recording medium, respectively, to guide a recording medium discharged from a fixing nip downstream. One of the pair of sheet guiding units facing the first side includes a first sheet guiding element disposed immediately downstream of the fixing nip and a second sheet guiding element disposed downstream of the first sheet guiding element. The second sheet guiding element is displaceable substantially perpendicular to the conveying direction of the recording medium and separate from the sheet guiding unit facing the second side when the sheet guiding unit separating mechanism is moved to separate from the fixing nip. The first and second sheet guiding elements together pivot around a first rotation fulcrum to separate from the fixing nip after the second sheet guiding element is displaced.

20 Claims, 7 Drawing Sheets

SHEET GUIDING UNIT SEPARATING MECHANISM, FIXING DEVICE WITH SHEET GUIDING UNIT SEPARATING MECHANISM, AND IMAGE FORMING APPARATUS WITH FIXING DEVICE WITH SHEET GUIDING UNIT SEPARATING MECHANISM

CROSS-REFERENCE TO RELATED APPLICATION

This patent application is based on and claims priority pursuant to 35 U.S.C. §119 to Japanese Patent Application No. 2013-000857, filed on Jan. 8, 2013 in the Japan Patent Office, the entire disclosure of which is hereby incorporated by reference herein.

BACKGROUND

1. Technical Field

The present invention relates to a sheet-guiding unit separating system, a fixing device with the sheet-guiding unit separating system, and an image forming apparatus with the fixing device with the sheet-guiding unit separating system. In particular, the present invention relates to a sheet-guiding mechanism to guide a recording medium discharged from a fixing nip of a fixing device, a fixing device with the sheet-guiding mechanism, and an image forming apparatus with the fixing device with the sheet-guiding mechanism.

2. Related Art

In the past, various types of image forming apparatuses, such as copiers, facsimiles, printers, etc., using an electrographic system have been proposed and well known. In the image forming apparatus, the following steps generally establish an image forming process. An electrostatic latent image is initially formed on a surface of a photoconductive (PC) drum serving as an image bearer. The electrostatic latent image on the photoconductive drum is then developed and rendered visible by toner or the like acting as a developing agent. The developed image is then transferred onto a recording medium (hereinafter, also variously sometimes referred to as a sheet, a recording sheet, a recording member, a transferring member) by a transfer device and is borne thereon. The toner image on the recording medium is then fixed onto the recording medium by a fixing device under pressure and heat or the like.

In the fixing device, a fixing member and a pressing member are opposed to each other as rotating members (e.g., rollers, belts, or a combination of each of them) while forming a nip (i.e., a fixing nip) therebetween. For example, in a roller type fixing device with an internal heater such as a halogen heater, etc., which forms the fixing nip by pressing a fixing roller (typically heated) and a pressing roller against each other, a recording medium bearing an unfixed toner image is conveyed through the fixing nip between these two rotating members (i.e., the fixing roller and the pressing roller) rotating in pressure with heat. The toner image is consequently heated and the pressed between these rotating members, and accordingly, melts due to the heat and is fixed on the recording medium.

Because the toner is mostly made of resin, and accordingly tends to melt in the fixing nip and adhere to a fixing member (e.g., a fixing roller and a fixing belt), the toner generally needs to be prevented from sticking to the fixing roller and the fixing belt or the like. Thus, there have been various attempts to prevent such sticking, such as adding wax compound to the toner, coating surfaces of the fixing roller and the fixing belt with releasable material, applying lubricant such as silicone oil, etc., to the surfaces of the fixing roller and the fixing belt, etc.

Further, a sheet separator with a separating nail (hereafter, sometimes collectively referred to as a separator, simply) may be attached to either a fixing roller or a fixing belt downstream, i.e., a sheet discharge side, of a fixing nip at a position immediately downstream of the fixing nip. The separator forcibly removes the recording medium that tends to wind around either the fixing roller or the fixing belt due to melting of the toner.

In recent years, to replace the separating nail, a sheet separator with a separating plate is sometimes attached to the fixing roller or the fixing belt across a narrow gap (i.e., separated therefrom). That is, a thin plate-like member is opposed to the fixing belt or the fixing roller immediately downstream of the fixing nip via the narrow gap not to avoid abrading the fixing roller or the fixing belt to avoid a problem caused by the separating nail.

Even so, the sheet separator, whether a separating nail, a separating plate, etc., cannot completely prevent the recording medium from winding around the fixing roller or the fixing belt. That is, when the separating nail or the separating plate is disposed close to the fixing roller or the fixing belt, and a sheet gets jammed, the jammed sheet is difficult to remove because it is usually is difficult to remove, because it is usually torn and/or partially left in a fixing device.

As a countermeasure against this problem, a sheet guiding unit separating system has been proposed to separate the separating nail, the separating plate, and a sheet guiding unit such as a guiding plate, etc., having the separating nail or plate, which is disposed in the sheet conveyance path immediately downstream of the fixing nip of the fixing roller or the fixing belt.

For example, in a conventional fixing device, more than one separating nail enabled to freely pivot around its shaft, a bracket having an elastic member, and a sheet ejection guiding unit having a lever, a pressing member, and a stopper nail pivoted by the lever are provided as a pivoting unit enabled to freely pivot around a prescribed axis of a fixing device. Further, the bracket unit is enabled to freely pivot around a fulcrum established in the above-described sheet ejection-guiding unit. Thus, when a sheet jam occurs and is to be dealt by operating the lever and pivoting the stopper nail unit away from a holder that holds a body of the fixing device, the pressing member presses against the elastic member to pivot the bracket unit so that the above-described sheet ejection guiding unit separates and allow access to the fixing nip. At the same time, a tip of the separating nail unit is separated from a surface of one of the rotating members.

SUMMARY

Accordingly, one aspect of the present invention provides a novel sheet guiding unit-separating mechanism employed in a fixing device that fixes an unfixed toner image onto a recording medium by providing heat and pressure thereto in a fixing nip formed between a pair of opposed rotating members and. The sheet guiding unit separating mechanism is disposed downstream of the fixing nip in a conveying direction in which the recording medium is conveyed. The sheet-guiding unit separating mechanism includes a pair of sheet guiding units disposed facing first and second sides of the recording medium, respectively, to cooperatively guide the recording medium discharged from the fixing nip downstream. One of the pair of sheet guiding units and facing the first side of the recording medium includes a first sheet guiding element disposed immediately downstream of the fixing nip and a second sheet guiding element disposed downstream of the first sheet guiding element. The second sheet guiding element is displaceable in a direction Y substantially perpendicular to the conveying direction X of the recording medium and separate from the sheet guiding unit facing the second side of the recording medium when the sheet guiding unit separating mechanism separates from the fixing nip. The first and second sheet guiding elements and together pivot around a first rotation fulcrum A serving as a first rotation center to separate from the fixing nip after the second sheet guiding element is displaced in a positive direction +Y substantially perpendicular to the conveying direction X of the recording medium.

Another aspect of the present invention provides a novel fixing device comprising: a housing: a pair of opposed rotating members to fix a unfixed toner image onto a recording medium by providing heat and pressure thereto in a fixing nip formed therebetween; and a sheet guiding unit separating mechanism disposed downstream of the fixing nip in a conveying direction in which the recording medium is conveyed. The sheet-guiding unit separating mechanism comprises a pair of sheet guiding units disposed facing first and second sides of the recording medium, respectively, to cooperatively guide the recording medium discharged from the fixing nip downstream. One of the pair of sheet guiding units faces the first side of the recording medium and includes a first sheet guiding element disposed immediately downstream of the fixing nip and a second sheet guiding element disposed downstream of the first sheet guiding element. The second sheet-guiding element is displaceable in a direction substantially perpendicular to the conveying direction of the recording medium and separates from the sheet-guiding unit facing the second side of the recording medium when the sheet-guiding unit separating mechanism is moved to separate from the fixing nip. The first and second sheet guiding elements together pivot around a first rotation fulcrum serving as a first rotation center to separate from the fixing nip after the second sheet-guiding element is displaced in a direction substantially perpendicular to the conveying direction of the recording medium.

Yet another aspect of the present invention provides a novel image forming apparatus comprising: a housing; an image forming unit to form a toner image; and the above-described fixing device.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

Figure 1:
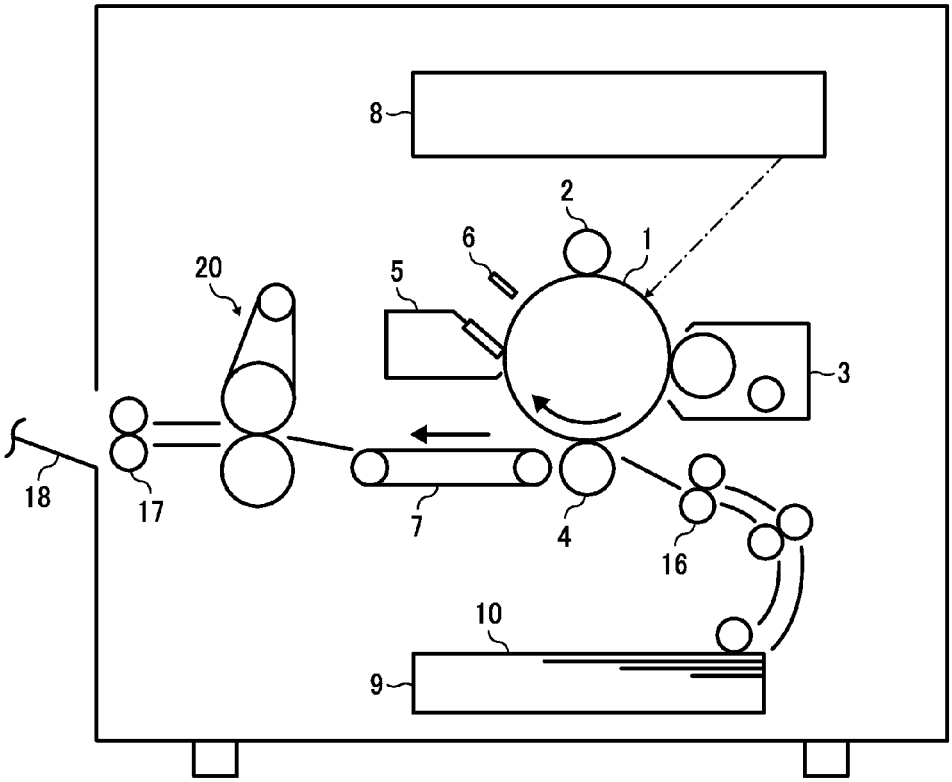
FIG. 1 is a cross-sectional view illustrating an exemplary image forming apparatus according to one embodiment of the present invention.

In the above-described related arts, however, since the sheet guiding unit separating mechanism is placed immediately downstream of the fixing nip, various constraints are imposed when it is separated from the fixing nip as described herein below with reference to FIGS. 6 to 8. Here, the reference X indicates a sheet conveying direction in the drawings.

Figure 6:
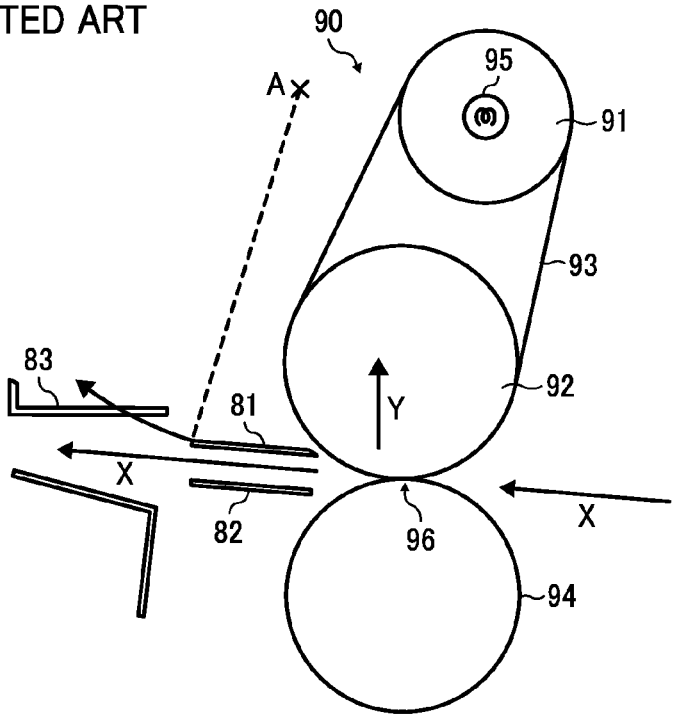
FIG. 6 RELATED ART
FIG. 6 is a cross-section view illustrating a comparative fixing device having a first challenge to overcome when a sheet guiding unit-separating system is employed.
Figure 7:
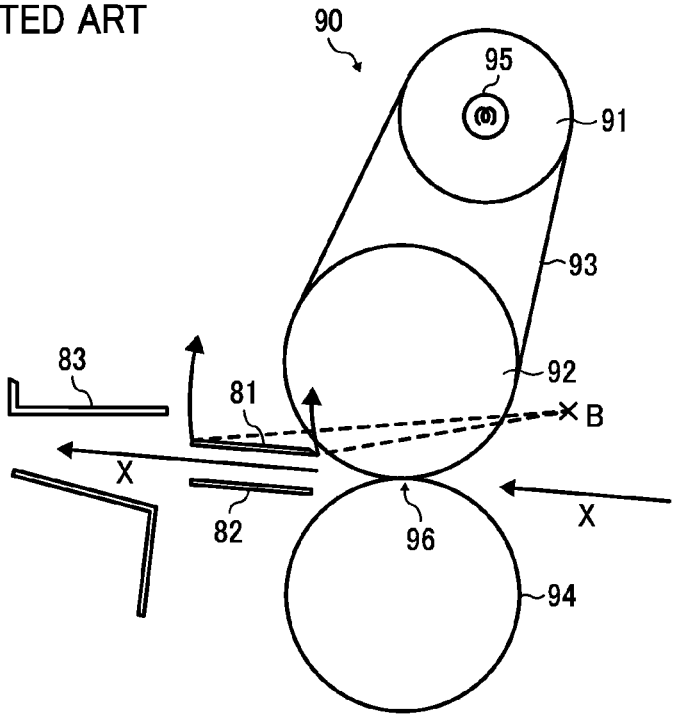
FIG. 7 RELATED ART
FIG. 7 is a cross-section view illustrating a comparative fixing device having a second challenge to overcome when a sheet guiding unit separating system is employed.
Figure 8:
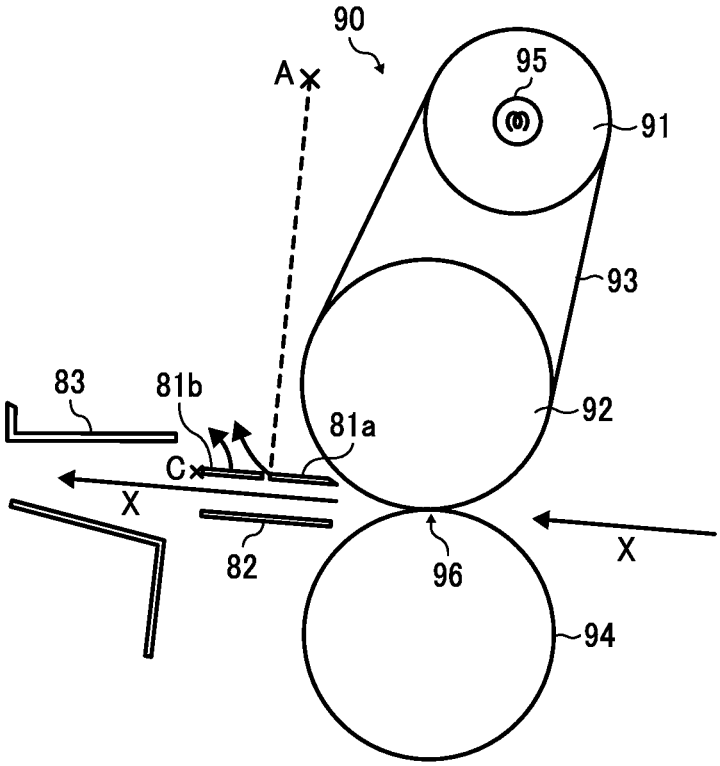
FIG. 8 RELATED ART
FIG. 8 is a cross-section view illustrating a comparative fixing device having a third challenge to overcome when a sheet-guiding unit separating system is employed.

That is, as shown in FIGS. 6 to 8, a fixing device 90 as a comparative example is generally constructed of a heating roller 91 with a heat source 95, a fixing roller 92, a fixing belt 93 stretched and wound around these heating and fixing rollers 91 and 92, and a pressing roller 94 pressing against the fixing roller 92 via the fixing belt 93. A fixing nip 96 is formed between the fixing belt 93 and the pressing roller 94 in the fixing device 90.

As shown in FIG. 6, to pivot and separate the guiding plate 81 having the separating plate collectively disposed immediately downstream of the fixing nip without interfering with the fixing roller 92 and the pressing roller 94 (herein below, collectively referred to as a pair of rollers), a rotation fulcrum of the separating mechanism needs to be located at a position distanced from the fixing nip 96 in a direction Y (for example, a rotation fulcrum A).

However, a pair of guiding plates 81 and 82 is established along a sheet conveyance path to guide a sheet ejected from the fixing device 90. Thus, in such a guiding plate separating mechanism as shown in FIG. 6, a trailing end of the guiding plate 81 with the separating plate conflicts with a guiding plate 83 provided further downstream thereof in the sheet conveyance path as shown by arrow in the drawing.

To avoid such a problem, a sufficient clearance is typically needed between the guiding plate 83 and the trailing end of the guiding plate 8. However, a sheet being transported can slip into the clearance or similar problems may occur, thereby causing a sheet jam as a problem.

Further, as shown in FIG. 7, when the rotation fulcrum of the guiding unit separating mechanism is alternatively located at a position B so that the trailing end of the guiding plate 81 including the separating plate can pivot while following a track not to interfere with the downstream side guiding plate 83, the tip of the guiding plate 81 interferes with the fixing belt 23 and the fixing roller 22 as well as shown by arrow in the drawing. Consequently, such a configuration cannot be practically employed.

Further, as shown in FIG. 8, the guiding plate 81 can be divided into two members as a separating plate 81*a* and a guiding plate 81*b* provided that a rotation fulcrum (for example, a rotation fulcrum A located in the direction Y) of the separating plate 81*a* and that of the guiding plate portion 81*b*, i.e., a rotation fulcrum C are separated from each other. In such a situation, conveyance performance can be improved by omitting the above-described sufficient clearance between the above-described two members.

However, since two mechanisms and actions are required to separate the guiding plate 81*b* and the separating plate 81*a*, such a system becomes considerably complicated and hinders removal of the jammed sheet.

Further, since the sheet guiding unit separating system is necessarily disposed immediately downstream of the fixing nip to obtain a wide working space for easily removing the jammed sheet or the like, various constraints need to be met to separate the guiding plate from the fixing nip without interfering with surrounding members. However, conventional devices are silent on this point.

Referring now to the drawings, wherein like reference numerals designate identical or corresponding parts throughout the several views thereof and in particular to FIG. 1, an outline of an interior and operation of an image forming apparatus according to one embodiment to resolve the above-described problems is described. Specifically, as shown in FIG. 1, an exemplary image forming apparatus according to one embodiment of the present invention is schematically illustrated.

In the image forming apparatus, a photoconductive member 1 as an image bearer is driven and pivoted by a driving device, not shown, in a direction as shown by arrow. When it is pivoted, a charging roller 2 uniformly charges a surface of the photoconductive member 1. An electrostatic latent image is formed on a charged portion when it is exposed to a laser light beam emitted from an optical writing device 8, and is developed and rendered visible by a developing unit 3 as a toner image.

On the other hand, a sheet 10 as a recording medium is fed from a sheet-feeding unit 9. The sheet 10 is conveyed by a pair of registration rollers 16 to a transfer unit synchronizing with the above-described toner image. In the transfer unit, the toner image is transferred onto the sheet 10 by a function of a transfer roller 4.

The sheet 10 with the toner image transferred thereon is then conveyed to the fixing device 20 by a sheet-conveying belt 7. The toner image is fixed by the fixing device 20 onto the sheet 10 to be a permanent image and exists onto a sheet-ejecting tray 18 through a pair of sheet ejecting rollers 17.

Further, residual toner remaining on the photoconductive member 1 is removed by a cleaning device 5 and it is cleaned after completing the transferring process. Subsequently, an electric charge-removing device 6 eliminates residual charge remaining on the photoconductive member 1 to prepare for the next image formation.

Here, the transferring unit (e.g., the transfer roller) 4, the sheet conveying belt 7, the fixing device 20, and the pair of sheet ejecting rollers 17 are enabled to be integrally pulled out from the image forming apparatus to ease removal of a jammed sheet 10 when sheet jam occurs.

Figure 2:
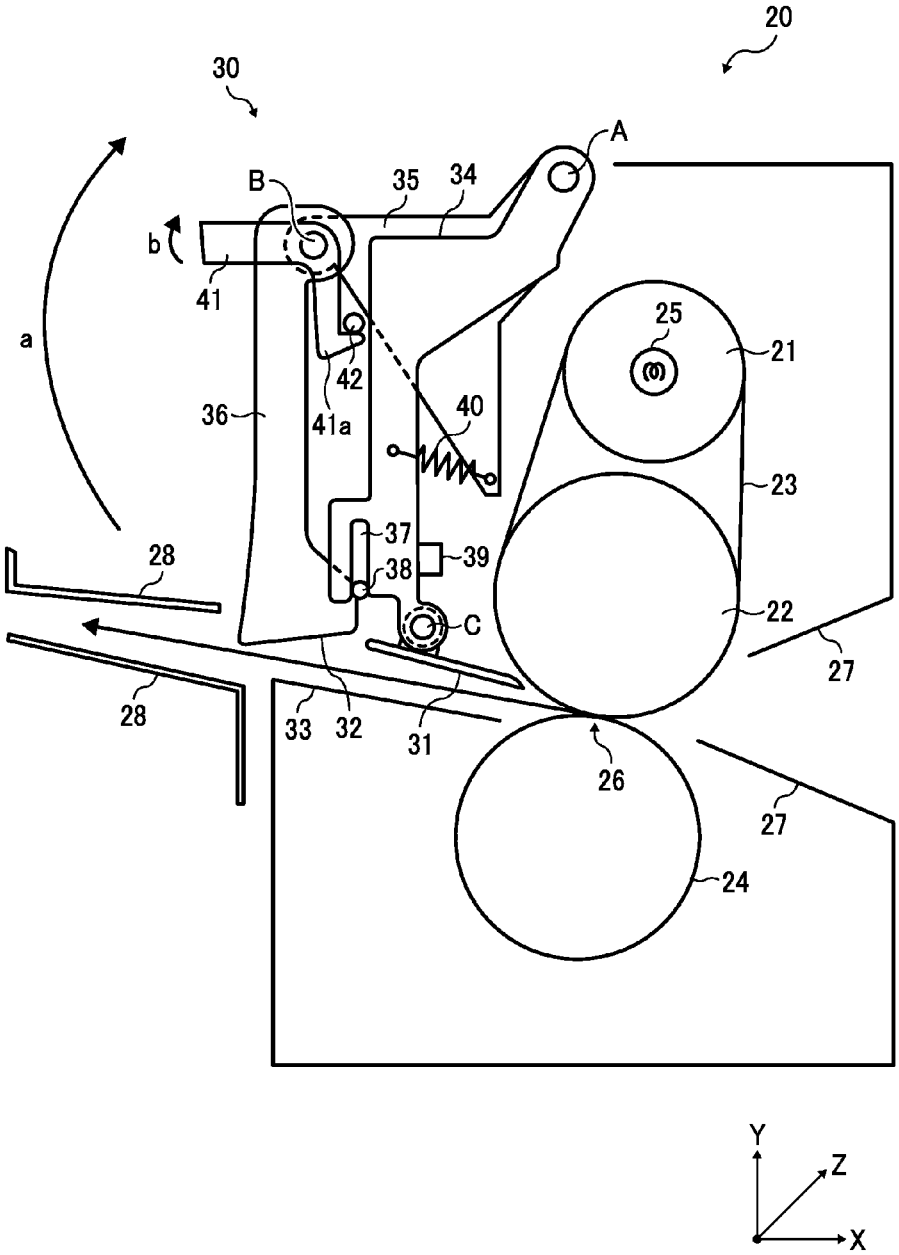
FIG. 2 is a cross-sectional view illustrating an overall configuration and a usage aspect of an exemplary fixing device according to one embodiment of the present invention.

Now, an exemplary fixing device 20 according to one embodiment of the present invention is described with reference to FIG. 2. As shown in FIG. 2, an exemplary fixing device 20 with a sheet-guiding unit opening and closing mechanism 30 is illustrated.

First, a basic configuration of the fixing device 20 is initially described. As shown in FIG. 2, the fixing device 20 includes a fixing belt 23 stretched and wound around a heating roller 21 and a fixing roller 22. The fixing device 20 also includes a pressing roller 24 pressed against the fixing roller 22 via the fixing belt 23.

The heating roller 21 is composed of a metal pipe made of aluminum, and accommodates a halogen lamp 25 as a heat source inside thereof.

The fixing roller 22 is also composed of a metal pipe with an elastic layer composed of silicone rubber having a thickness of approx. 0.1 mm to approx. 20 mm overlying its front surface.

The fixing belt 23 is prepared by including a cylindrical belt made of such as heat-resistant polyimide resin, etc., as a substrate, a silicone rubber layer overlying a front surface of the substrate having a thickness of from about 0.1 mm to about 1 mm, and a PFA (Tetrafluoroethylene-Perfluoroalkyl Vinyl Ether Copolymer) tube having a thickness of from about 20 μm to about 200 μm further overlying a front surface of the silicone rubber layer as a cover.

The pressing roller 24 is prepared by including a metal pipe, a silicone rubber layer having a thickness of from about 1 mm to about 5 mm overlying a front surface of the metal pipe, and a PFA (Tetrafluoroethylene-Perfluoroalkyl vinyl ether copolymer) tube having a thickness of from about 20 μm to about 200 μm further overlying a front surface of the silicone rubber layer as a cover.

The fixing belt 23, the fixing roller 22, and the heating roller 21 are pivoted by the pressing roller 24 further driven by a driving device, not shown.

The halogen lamp 25 is controlled to be turned on and off based on a detection result of a temperature-detecting unit, not shown, that detects surface temperature of the fixing belt 23 so that the surface temperature of the fixing belt 23 can range within a prescribed scope.

When a sheet with a toner image thereon is sent and sandwiched by the fixing roller 22 and the pressing roller 24 in a fixing nip 26 formed therebetween by pressing these fixing and pressing rollers 22 and 24 against each other via the fixing belt 23 and is further conveyed therefrom, the above-described fixing device 20 fixes the toner image onto the sheet 10 by providing heat and pressure thereto.

Specifically, the sheet 10 is guided to the fixing nip 26 from a pair of upstream side sheet guiding units 27 located upstream of the fixing nip 26, and is subsequently guided between a pair of sheet guiding units 31 and 32 disposed side by side facing an upper surface of the sheet 10 and a sheet guiding unit 33 disposed facing a lower surface of the sheet 10 in the conveying direction after completing the fixing process. The sheet 10 is subsequently further guided downstream to a downstream side pair of sheet guiding unit 28 disposed further downstream. The pair of upstream side sheet guiding units 27 may be configured as a part of a housing of the fixing device 20 or is separately provided.

Further, the fixing device 20 is equipped with a sheet-guiding unit opening and closing unit 30 serving as a sheet-guiding unit separating mechanism as described herein below according to one embodiment of the present invention.

A configuration of the above described belt type fixing device 20 is just an example, and various configurations of fixing devices such as a roller type fixing device, etc., can be employed as a modification. Further, at least the fixing device 20 and the downstream side pair of sheet guiding units 28 are enabled to be integrally separated from the image forming apparatus as a unit.

Further, the fixing device 20 is not privately employed in the image forming apparatus, and can be widely adopted in the other systems capable of conveying and heating it while pressing a recording medium.

Now, a sheet guiding unit opening and closing unit 30 as a guide member separating system installed in the fixing device 20 is described in more detail with reference to FIGS. 2 to 5. Note here that, as shown in FIGS. 2, a reference X indicates a sheet conveying direction, while a reference Y indicates a direction perpendicular to the direction X in FIGS. 2 to 5. A reference Z also indicates a direction perpendicular to a plane of the sheet 10 (i.e., a shaft direction of a rotating member, and accordingly, a depth in the drawing). Thus, for example, a direction in which a sheet 10 is conveyed from the fixing nip 26 corresponds to the negative direction −X.

A sheet guiding unit-separating mechanism is employed in a fixing device 20 that fixes an unfixed toner image onto a recording medium 10 by providing heat and pressure thereto in a fixing nip 26 formed between a pair of opposed rotating members 23 and 24. The sheet guiding unit separating mechanism is disposed downstream of the fixing nip 26 in a conveying direction in which the recording medium 10 is conveyed. The sheet-guiding unit separating mechanism includes a pair of sheet guiding units 31 to 33 disposed facing first and second sides of the recording medium 10, respectively, to cooperatively guide the recording medium 10 discharged from the fixing nip 26 downstream. One of the pair of sheet guiding units 31 and 32 facing the first side of the recording medium 10 includes a first sheet guiding element 31 disposed immediately downstream of the fixing nip and a second sheet guiding element 32 disposed downstream of the first sheet guiding element 31. The second sheet guiding element 32 is displaceable in a direction Y substantially perpendicular to the conveying direction X of the recording medium 10 and separate from the sheet guiding unit 33 facing the second side of the recording medium 10 when the sheet guiding unit separating mechanism is moved to separate from the fixing nip 26. The first and second sheet guiding elements 31 and 32 together pivot around a first rotation fulcrum A serving as a first rotation center to separate from the fixing nip 26 after the second sheet guiding element 32 is displaced in a positive direction +Y substantially perpendicular to the conveying direction X of the recording medium 10.

Further, the rotation fulcrum A is disposed above the fixing nip 26 in a direction Y substantially perpendicular to the conveying direction X of the recording medium 10. The sheet guiding unit separating mechanism further includes a first bracket unit 34 enabled to freely pivot around the first rotation fulcrum A as a first rotation center. The first bracket unit 34 has a given length extending substantially perpendicular to the sheet conveying direction X of the recording medium 1 from the first rotation fulcrum A toward the sheet guiding unit 33 facing the other side of the recording medium 10. A second bracket unit 35 is provided to link the first rotation fulcrum A to a second rotation fulcrum B disposed beside the first rotation fulcrum A in the conveying direction X of the recording medium 10. A third bracket unit 36 is provided and enabled to freely pivot around the second rotation fulcrum B. The third bracket unit 36 has a given length extending substantially perpendicular to the sheet conveying direction X of the recording medium 10 from the second rotation fulcrum B toward the sheet guiding unit 33 facing the other side of the recording medium 10. The first sheet-guiding unit 31 is provided (or formed) at a pivoting leading end of the first bracket unit 34. The second sheet-guiding unit 32 is provided (or formed) at a pivoting leading end of the third bracket unit 36.

Here, each of the bracket units collectively constituting the sheet guiding unit separating mechanism is provided at least in each of widthwise ends of the rotating members in its axial direction (i.e., in the direction Z). Further, the first and second guiding units are provided either entirely extending in the axial direction or at multiple locations at a prescribed interval in the direction.

Herein below, the above-described embodiment is more specifically described. Since toner having melted on the sheet 10 tends to stick to the fixing belt 23 during fixing operation in the fixing device 20, the sheet 10 passing through and from the fixing nip 26 likely winds around the fixing belt 23.

Thus, a sheet separator is provided immediately downstream of the fixing nip to separate the sheet 10 tending to wind around the fixing belt 23 therefrom. For example, in the fixing device of FIG. 2, a first sheet-guiding unit 31 including a separating plate is provided immediately downstream of the fixing nip 26 with it separated from the fixing belt 23 to serve as a sheet separator.

Further, the sheet guiding unit opening and closing unit 30 including the first sheet-guiding unit 31 is enabled to pivot around a rotation fulcrum A provided in the fixing device 20. The rotation fulcrum A is established at a prescribed position apart from the fixing nip 26 in a positive direction +Y.

Figure 5:
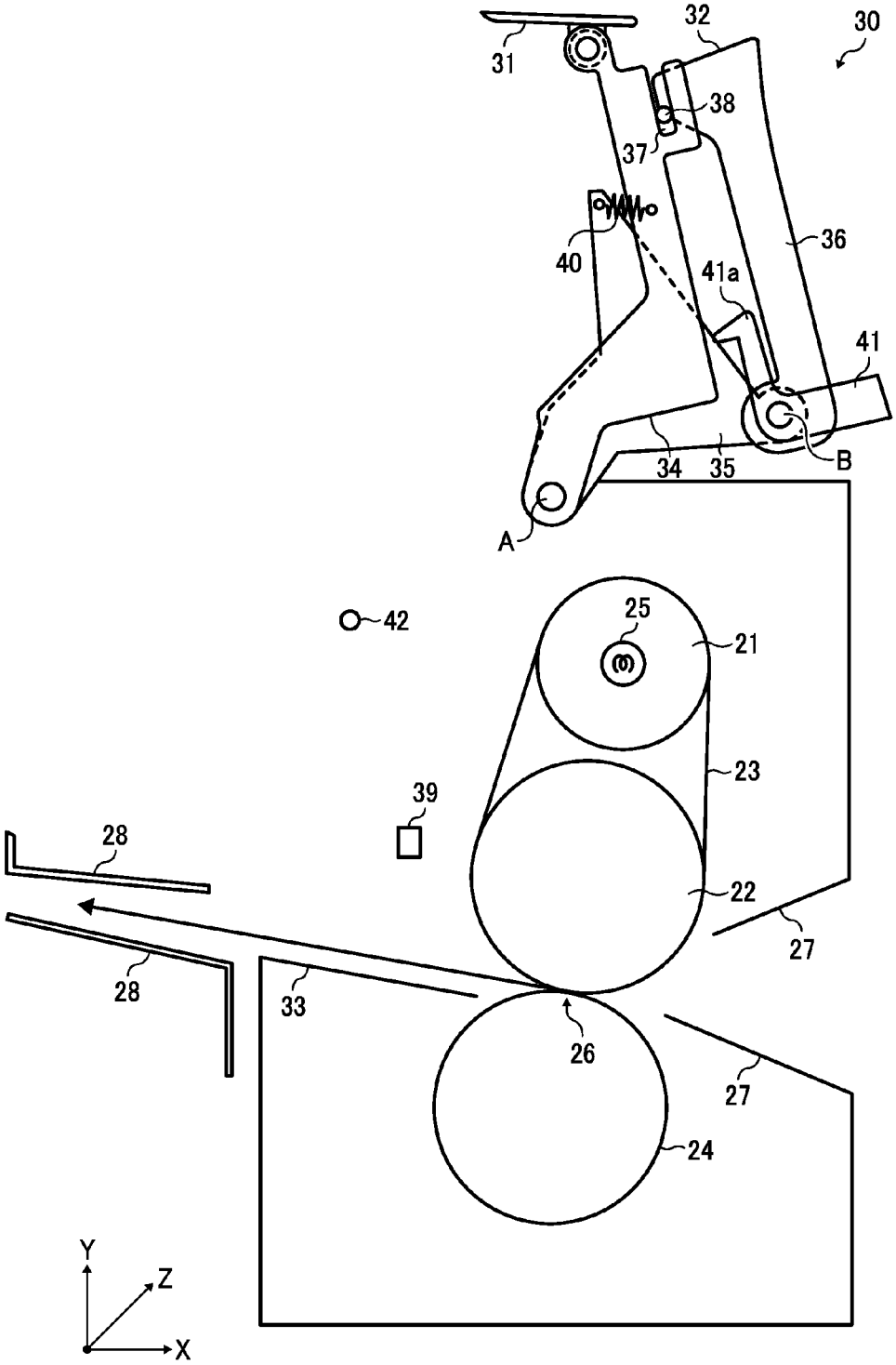
FIG. 5 is a cross-sectional view illustrating an aspect of the fixing device of FIG. 2 when the sheet-guiding unit opening and closing unit completes pivoting according to one embodiment of the present invention.

When sheet jam occurs in the fixing device 20 and a jammed sheet 10 is to be removed, at least the fixing device 20 and the downstream side pair of sheet guiding unit 28 are drawn from a main body of the image forming apparatus. After that, the sheet guiding unit opening and closing unit 30 is pivoted clockwise (as shown by arrow a) from a state as shown in FIG. 2, while exposing the lower sheet guiding unit 33 serving as a sheet conveying surface at a lower side of the sheet conveying path as shown in FIG. 5, so that the jammed sheet 10 can be removed. The separating system is described later more in detail.

A sheet-guiding unit located on an upper side of the sheet-conveying path in the sheet conveying direction to serve a sheet-conveying surface is composed of first and second sheet guiding units 31 and 32.

The first sheet-guiding unit 31 is composed of a so-called non-contact type separating plate, and is supported to be able to pivot by a slight amount around a fulcrum C. The first sheet guiding unit 31 is pressed toward the fixing belt 23 by a pair of butting members, not shown, provided in a none-sheet feeding region (e.g., at both ends in the direction Z) receiving a bias from a spring member or the like, so that a gap between a tip of the separating plate and the fixing belt 23 ranges from about 0 mm to about 1 mm.

The first sheet-guiding unit 31 is prepared by using a metal thin plate with its sheet conveying surface side being subjected to fluorine resin processing to avoid toner on the sheet 10 sticking thereto. However, the configuration or the like of the first sheet-guiding unit 31 as the separating plate is not especially limited to the above-described example, and a separating plate having a known or new configuration can be adopted. Furthermore, the first sheet-guiding unit may additionally include a separate claw.

Further, the fulcrum C of the first sheet-guiding unit 31 is provided on a leading end side of the first bracket unit 34 in the negative direction −Y having a rotation center at the fulcrum A. Since the first bracket unit 34 pivots clockwise (i.e., as shown by arrow a) around the rotation fulcrum A, the first sheet guiding unit 31 supported by this also pivots clockwise (i.e., as shown by arrow a) around the rotation fulcrum A when the jammed sheet 10 is to be removed. Consequently, the first sheet-guiding unit 31 is separated from the fixing nip 26 and the sheet-conveying surface (i.e., the lower sheet guiding unit 33) as well. Further, since the rotation fulcrum A is located apart from the fixing nip 26 in the positive direction +Y, the first sheet guiding unit 31 does not contact the fixing belt 23 as the comparative example as described with reference to FIG. 7 even when the sheet guiding unit opening and closing unit 30 pivots.

The second sheet-guiding unit 32 is composed of a guiding plate located between the first sheet-guiding unit 31 and the downstream side pair of sheet guiding units 28 secured and not subjected to the separation operation. The second sheet-guiding unit 32 has a surface to which a fluorine resin sheet, not shown, is attached, to avoid toner on the sheet 10 from readily sticking thereto.

Further, on a side of a leading end of the second bracket unit 35 in the negative direction −X, which links the rotation fulcrums A and B to each other and pivots around the rotation fulcrum A, a third bracket unit 36 rotating around the rotation fulcrum B is disposed. Thus, the third bracket unit 36 is provided apart from the rotation fulcrum B in the negative direction −Y. Further, the rotation fulcrum B is located apart from the rotation fulcrum A in the negative direction −X and the second sheet-guiding unit 32 in the positive direction +Y. Here, the position of the rotation fulcrum B is not limited only to that shown in FIG. 2, and various positions allowing the later described separating operation are employable as well.

Further, the second sheet-guiding unit 32 is disposed at a leading end of the third bracket unit 36 in the negative direction −Y.

In the third bracket unit 36, a guiding pin 38 is provided near the second sheet-guiding unit 32 in the positive direction +Y. This guiding pin 38 fits into a rail portion 37 established in the first bracket unit 34.

The rail portion 37 of the first bracket unit 34 has a given length extending just in parallel or substantially in parallel to the direction Y in the first bracket unit 34. The guiding pin 38 is located on the side of one end of the rail portion 37 in the negative direction −Y in an ordinary condition (i.e., a non-separating condition, an initial position, a normal operating condition of a fixing device) or the like as shown in FIG. 2. Specifically, as described later, when the sheet guiding unit opening and closing unit 30 starts the separating operation, the guiding pin 38 moves along the rail portion 37 in the positive direction +Y. Thus, both of the guiding pin 38 and the rail portion 37 collectively serve as a regulation device that regulates displacement of the third bracket unit 36 in the direction Y in relation to the first bracket unit 34.

Further, on the same axis as the rotation fulcrum B, an operation lever 41 is provided as an operation member, with which the separating operation of the sheet-guiding unit opening and closing unit 30 can be externally manipulated. A hook shaped portion 41*a* is formed in the operation lever 41 and engages with a lock pin 42 built in a housing of the fixing device 20, so that the sheet guiding unit opening and closing unit 30 is locked not to open up. Thus, the hook shape portion 41*a* and the locking pin 42 collectively act as a locking device that locks the sheet-guiding unit opening and closing unit 30.

The sheet guiding unit opening and closing unit 30 is biased by a biasing device such as a spring, etc., not shown, clockwise around the rotation fulcrum A. Accordingly, when the operation lever 41 is slightly pivoted clockwise (i.e., in a direction as shown by arrow b) around the rotation fulcrum B as the rotation center, it disengages with the locking pin 42, and the sheet guiding unit opening and closing unit 30 starts the separating motion clockwise.

Here, according to one embodiment of the present invention, it is only needed that the sheet guiding unit opening and closing unit 30 is biased in the ordinary state as shown in FIG. 2, and such a biasing condition is cancelled by operating the operation member to pivot the opening and closing unit 30 clockwise. However, the shape and the configuration of the operation member and the lock member are not limited to the above-described examples, respectively.

Further, a spring 40 is provided as the biasing member between near a central portion of the first bracket unit 34 when viewed in the direction Y and a leading end of the second bracket unit 35 when viewed in the negative direction −Y.

With this spring 40, the first bracket unit 34 is biased counterclockwise around the rotation fulcrum A, i.e., in a direction reverse to the separating direction. Whereas, the second bracket unit 35 is biased clockwise by the spring 40 around the rotation fulcrum A, i.e., in the same direction with the separating direction. The installation position or the like of the spring 40 is not limited to the above-described example as shown in FIG. 2, and is only needed to bias the first and second bracket units 34 and 35 in the above-described direction.

Further, the first bracket unit 34 is configured to determine its position when it bumps a stopper 39 established in the housing of the fixing device 20 receiving a biasing force from the spring 40.

Now, an exemplary separating operation executed by the sheet guiding unit opening and closing unit 30 is described with reference to FIG. 2. In the ordinary state as shown in FIG. 2, an operator manipulates the operation lever 41. When the operation lever 41 is pivoted accordingly around the rotation fulcrum B in the direction as shown in by arrow b as the rotation center, the hook shape portion 41*a* of the operation lever 41 disengages with the locking pin 42, the sheet guiding unit opening and closing unit 30 starts moving clockwise around the rotation fulcrum A receiving a biasing force from a biasing device such as spring etc., not shown.

Figure 3:
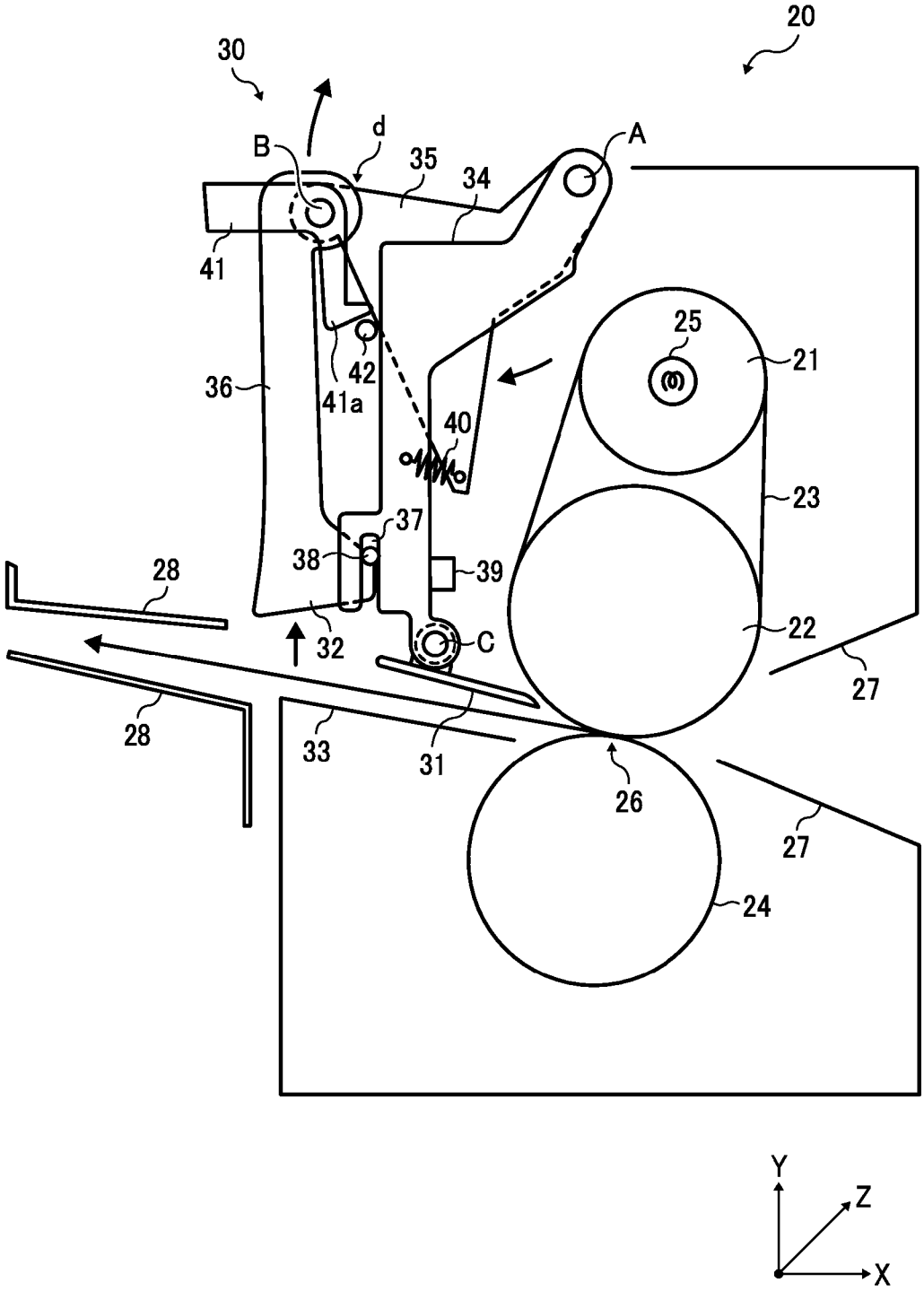
FIG. 3 is a cross-sectional view illustrating an aspect of the fixing device of FIG. 2 immediately after a sheet guiding unit opening and closing unit starts pivoting motion according to one embodiment of the present invention.

An aspect of the sheet guiding unit opening and closing unit 30 shortly after start of the rotational motion is shown in FIG. 3. Specifically, as there shown, the second bracket unit 35 links the rotation fulcrums A and B to each other, and the rotation fulcrum B pivots around the rotation fulcrum A as a rotation center. Since a linear line extended over the rotation fulcrums A and B is parallel with the direction X, the rotation fulcrum B moves in the direction Y at the beginning of its pivoting movement around the rotation fulcrum A.

In this way, since the rotation fulcrum B (accordingly, the second bracket unit 35, the third bracket unit 36, and the operation lever 41) starts movement around the rotation fulcrum A located in the direction X, it rises substantially in the positive direction +Y in an early stage of its pivoting movement.

Here, since the guiding pin 38 is restricted by the rail portion 37 of the first bracket unit 34 in the leading end of the third bracket unit 36 only to move in the direction Y, the third bracket unit 36 accordingly moves in the positive direction +Y.

During transition from the state as shown in FIG. 2 to the state as shown in FIG. 3, since the first bracket unit 34 is biased by the spring 40 to pivot counter clockwise around the fulcrum A, it does not change its position (i.e., it does not move). Specifically, as described above, since the first bracket unit 34 is biased in the opposite direction to that the operation lever 41 pivots in the normal condition, it can keep a biased condition counterclockwise even when the second bracket unit 35 starts rotating as the operation lever 41 starts pivoting while the biasing force applied to the first bracket unit 34 is gradually weakened.

Hence, shortly after the operation lever 41 starts pivoting, the second sheet guiding unit 32 can be absolutely separated from the lower sheet guiding unit 33 and the fixing nip 26 in the positive direction +Y. Further, when the second sheet guiding unit 32 separates in the positive direction +Y, both the first sheet guiding unit 31 and the second sheet guiding unit 32 separate (from each other) while pivoting (as different from the above described example), the second sheet guiding unit 32 insufficiently separates in the Y direction and likely interferes with of one the downstream side pair of sheet guiding units 28. However, according to one embodiment of the present invention as described above, such a problem can be likely avoided.

Here, because a stopper, not shown, stops it, the third bracket unit 36 does not further move through a position in the positive direction +Y as shown in FIG. 3. Specifically, the stopper contacts and prohibits its movement only in the positive direction +Y when the third bracket unit 36 comes to a position as shown in FIG. 3. The stopper is disposed at a position (e.g. a position indicated by arrow d in FIG. 3) not to regulate overall movement of the sheet guiding unit opening closing section 30 (i.e., a diagonal movement of the third bracket unit 36 from a state as shown in FIG. 3 in +Y and −X directions) described hereinafter.

Further, instead of the stopper, a length of the rail portion 37 of the first bracket unit 34 is adjusted in the direction Y so that the guiding pin 38 reaches the uppermost end of the rail portion 37 and regulates the third bracket to further move in the positive direction +Y when the first bracket unit 34 comes to the position as shown in FIG. 3.

Hence, as the third bracket unit 36 moves in the positive direction +Y, the second sheet guiding unit 32 formed at the end of the third bracket unit 36 in the negative direction −Y also moves in the positive direction +Y, and accordingly, stops at the position as shown in FIG. 3 as well.

Subsequently, when the sheet guiding unit opening closing section 30 as a whole pivots around the rotation fulcrum A as a rotation center while keeping the second sheet guiding unit 32 temporarily (currently) separating in the positive direction +Y as shown in FIG. 3, the sheet guiding unit opening and closing unit 30 can evacuate from the fixing nip and the lower sheet guiding unit 33 as well while avoiding interference of the second sheet-guiding unit 32 and the downstream side sheet guiding unit 28 with each other.

Figure 4:
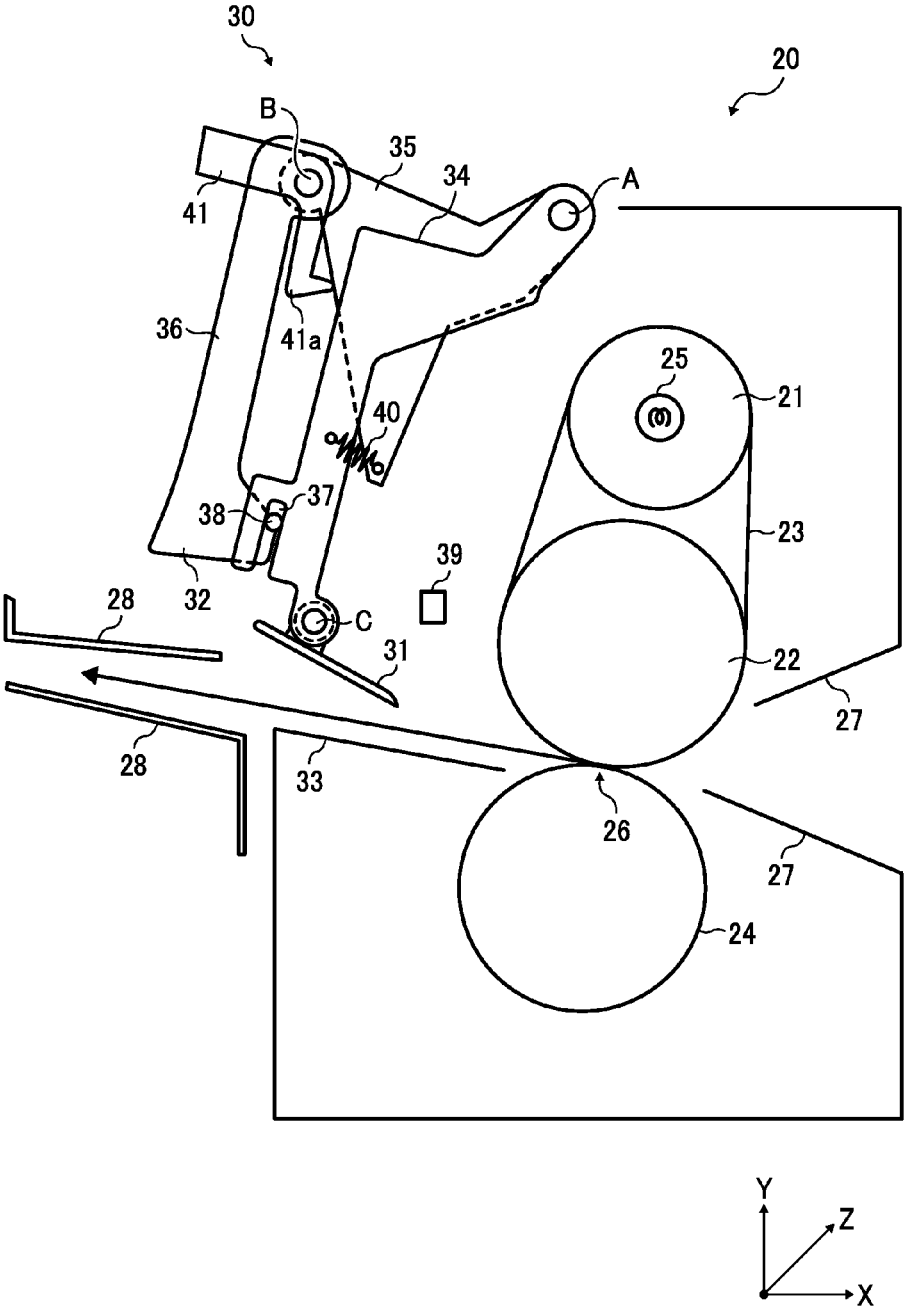
FIG. 4 is a cross-sectional view illustrating an aspect of the fixing device of FIG. 2 when the sheet-guiding unit opening and closing unit is pivoting according to one embodiment of the present invention.

Now, an aspect of the sheet-guiding unit opening and closing unit 30 when it is pivoted from the state as shown in FIG. 3 is described with reference to FIG. 4. As there shown, both the second and third bracket units 35 and 36 pivot around the fulcrum A as a rotation center maintaining positional relations of those with each other as illustrated in the drawing. Since the bias applied to the first bracket unit 34 by the spring 40 is cancelled, and the first bracket unit 34 is linked to the third bracket unit 36 via the guiding pin 38, the first bracket unit 34, movement of which is regulated by the rail portion 37, also pivots together as the guiding pin 38 swings around the rotation fulcrum A.

In this way, the sheet-guiding unit opening and closing unit 30 together pivots clockwise and is separated from the fixing nip 26 and the lower sheet-guiding unit 33 as well. Further, when the sheet guiding unit opening and closing unit 30 continuously pivots and enters a state as shown in FIG. 5, the first and second sheet guiding units 31 and 32 are completely separated from the fixing nip 26 and the lower sheet guiding unit 33 as well, so that the bottom guiding plate 33 serving as the sheet conveying surface is widely exposed. Accordingly, a space to allow an operator to remove a jammed sheet from a section immediately downstream of the fixing nip can be created.

Further, when the sheet guiding unit opening and closing unit 30 is to be closed and returned to the state as shown in FIG. 2 after removal of the jammed sheet 10 from the state as shown in FIG. 5, the operator then picks the operation lever 41 up and pivots the sheet guiding unit opening closing section 30 counterclockwise to return it as shown in FIG. 3. Subsequently, the operator depresses a portion of the sheet-guiding unit opening and closing unit 30 near an axis of the rotation fulcrum B in the negative direction −Y, and engages the lock pin 42 with the hook shaped portion 41*a* of the operation lever 41. Accordingly, the sheet-guiding unit opening and closing unit 30 can be returned to the state as shown in FIG. 2.

As described heretofore, in the sheet guiding unit opening and closing unit 30 according to one embodiment of the present invention, the rotation fulcrum A is provided at the position apart from the fixing nip 26 in the positive direction +Y so that the first sheet guiding unit 31 provided immediately downstream of the fixing nip as the separating plate does not contact the fixing belt 23 when it evacuates from the fixing nip. Further, since the operator manipulates the operation member, only the second sheet guiding unit 32 is initially separated by a prescribed distance from the sheet conveying surface in the positive direction +Y. Afterwards, the sheet guiding unit opening and closing unit 30 together pivots around the rotation fulcrum A as a rotation center.

Hence, the sheet guiding unit opening and closing unit 30 can pivot and evacuate from the fixing nip 26 without interfering with the downstream side sheet guiding unit 28 located downstream of the second sheet guiding unit 32 while creating a space for removing a jam sheet 10. Further, since a great space is not needed between the sheet guiding units 31 and 32, and 33 and the downstream side pair of sheet guiding unit 28, the sheet 10 neither sneaks into the great space nor causes conveyance jam.

Further, since the first sheet guiding unit 31 located close to the fixing nip 26 does not evacuate in the positive direction +Y as different from the second sheet guiding unit 32, the first sheet guiding unit 31 does not interfere with the fixing belt 23, and is able to safely separate from the sheet conveying surface when the sheet guiding unit opening and closing unit 30 pivots around the rotation fulcrum A.

Further, since the operation lever 41 is coaxially provided as the rotation fulcrum B, the second sheet guiding unit 32 can be absolutely separated in the positive direction +Y by operation force generated after the operation lever 41 starts pivoting.

Further, to separate the above-described two sheet guiding units 31 and 32, at least two actions are generally needed. However, with the sheet-guiding unit opening and closing unit 30 according to one embodiment of the present invention, only single action of manipulating the operation member can completely separate these sheet-guiding units 31 and 32 from the sheet-conveying surface. For this reason, when compared with a configuration with which several operations are needed in opening and closing actions, usability is upgraded, and accordingly, the operator can easily manipulate the operation member.

Although it is provided on the side of the sheet guiding units 31 and 32 disposed on the side of the fixing member immediately downstream of the fixing nip in the above-described exemplary embodiments, the sheet guiding unit opening and closing unit 30 can be disposed on the side of the pressing member immediately downstream of the fixing nip, or both sides of the fixing member and the pressing member immediately downstream of the fixing nip.

Although the above-described various embodiments describe the examples, in which the first sheet-guiding unit 31 is composed of the single separating plate, the first sheet-guiding unit 31 can be composed of multiple guiding plates separated in the conveying direction side by side. For example, the first sheet guiding unit 31 can include a thin metallic separating plate disposed immediately downstream of the fixing nip while providing a heat-resistant plastic guiding plate downstream thereof. The first sheet-guiding unit 31 is not limited to the above-described separating plate and can be a separate claw type, of course. In such a situation, multiple separating nails are preferably placed in the direction Z. Further, the second sheet-guiding unit 32 can also be composed of multiple guiding plates separated in the conveying direction side by side as well as the first sheet-guiding unit 31.

According to one aspect of the present invention, a sheet-guiding unit can be separated from a fixing nip without interfering with a surrounding member while ensuring a working space for dealing sheet jam when the sheet jam occurs. That is, a sheet guiding unit-separating mechanism is employed in a fixing device 20 that fixes an unfixed toner image onto a recording medium 10 by providing heat and pressure thereto in a fixing nip 26 formed between a pair of opposed rotating members 23 and 24. The sheet guiding unit separating mechanism is disposed downstream of the fixing nip 26 in a conveying direction in which the recording medium 10 is conveyed. The sheet-guiding unit separating mechanism includes a pair of first and second sheet guiding units 31 to 33 disposed facing first and second sides of the recording medium 10, respectively, to cooperatively guide the recording medium 10 discharged from the fixing nip 26 downstream. One of the pair of sheet guiding units 31 and 32 facing the first side of the recording medium 10 includes a first sheet guiding element 31 disposed immediately downstream of the fixing nip and a second sheet guiding element 32 disposed downstream of the first sheet guiding element 31. The second sheet guiding element 32 is displaceable in a direction Y substantially perpendicular to the conveying direction X of the recording medium 10 and separate from the sheet guiding unit 33 facing the second side of the recording medium 10 when the sheet guiding unit separating mechanism is moved to separate from the fixing nip 26. The first and second sheet guiding elements 31 and 32 together pivot around a first rotation fulcrum A serving as a first rotation center to separate from the fixing nip 26 after the second sheet guiding element 32 is displaced in a positive direction +Y substantially perpendicular to the conveying direction X of the recording medium 10.

According to another aspect of the present invention, a sheet-guiding unit can be separated from a fixing nip without interfering with a surrounding member while more effectively ensuring a working space for dealing sheet jam when the sheet jam occurs. Because, the rotation fulcrum A is disposed above the fixing nip 26 in a direction Y substantially perpendicular to the conveying direction X of the recording medium 10. The sheet guiding unit separating mechanism further includes a first bracket unit 34 enabled to freely pivot around the first rotation fulcrum A as a first rotation center. The first bracket unit 34 has a given length extending substantially perpendicular to the sheet conveying direction X of the recording medium 1 from the first rotation fulcrum A toward the sheet guiding unit 33 facing the other side of the recording medium 10. A second bracket unit 35 is provided to link the first rotation fulcrum A to a second rotation fulcrum B disposed beside the first rotation fulcrum A in the conveying direction X of the recording medium 10. A third bracket unit 36 is provided and enabled to freely pivot around the second rotation fulcrum B. The third bracket unit 36 has a given length extending substantially perpendicular to the sheet conveying direction X of the recording medium 10 from the second rotation fulcrum B toward the sheet guiding unit 33 facing the other side of the recording medium 10. The first sheet-guiding unit 31 is provided (or formed) at a pivoting leading end of the first bracket unit 34. The second sheet-guiding unit 32 is provided (or formed) at a pivoting leading end of the third bracket unit 36. According to yet another aspect of the present invention, a sheet-guiding unit can be separated from a fixing nip without interfering with a surrounding member while more effectively ensuring a working space for dealing sheet jam when the sheet jam occurs. That is, a biasing member is provided to bias the second bracket unit in a first direction in which the sheet-guiding unit separating mechanism pivots. The biasing member biases the first bracket unit in a second direction opposite the first direction in which the sheet-guiding unit separating mechanism pivots and the biasing member determines a position of the first bracket unit.

According to yet another aspect of the present invention, a sheet-guiding unit can be separated from a fixing nip without interfering with a surrounding member while more effectively ensuring a working space for dealing sheet jam when the sheet jam occurs. That is, the first and third bracket units include regulation members to regulate displacement of the third bracket unit to and from the first bracket unit in a direction substantially perpendicular to the conveying direction of the recording medium.

According to yet another aspect of the present invention, a sheet-guiding unit can be separated from a fixing nip without interfering with a surrounding member while more effectively ensuring a working space for dealing sheet jam when the sheet jam occurs. That is, an operation member externally manipulated is provided to separate the sheet-guiding unit separating mechanism from the fixing nip.

According to yet another aspect of the present invention, a sheet-guiding unit can be separated from a fixing nip without interfering with surrounding members while more effectively ensuring a working space for dealing sheet jam when the sheet jam occurs. That is, an operation member externally manipulated is provided to freely coaxially pivot around the rotation fulcrum B. The operation member includes a locking member to lock the sheet-guiding unit separating mechanism in an initial position of the sheet guiding unit-separating mechanism before separating operation and the sheet guiding unit-separating mechanism is separated from the fixing nip by unlocking the locking member.

According to yet another aspect of the present invention, a sheet-guiding unit can be separated from a fixing nip without interfering with surrounding members while more effectively ensuring a working space for dealing sheet jam when the sheet jam occurs. That is, the first sheet-guiding unit is placed beside one of the pair of opposed rotating members at a given interval therefrom. The first sheet-guiding unit includes a separating plate to peel off the recording medium from the one of the pair of opposed rotating members.

Numerous additional modifications and variations of the present invention are possible in light of the above teachings. It is therefore to be understood that within the scope of the appended claims, the present invention may be executed otherwise than as specifically described herein. For example, the order of steps for forming the image forming apparatus is not limited to the above-described various embodiments and can be appropriately changed.

What is claimed is:

1. A sheet guiding unit separating mechanism employed in a fixing device that fixes a unfixed toner image onto a recording medium by providing heat and pressure thereto in a fixing nip formed between a pair of opposed rotating members, the sheet guiding unit separating mechanism disposed downstream of the fixing nip in a conveying direction in which the recording medium is conveyed, the sheet guiding unit separating mechanism comprising:

a pair of first and second sheet guiding units disposed facing first and second sides of the recording medium, respectively, to cooperatively guide the recording medium discharged from the fixing nip downstream, one of the pair of sheet guiding units facing the first side of the recording medium and including a first sheet guiding element disposed immediately downstream of the fixing nip and a second sheet guiding element disposed downstream of the first sheet guiding element, wherein the second sheet guiding element is displaceable in a direction substantially perpendicular to the conveying direction of the recording medium and separates from the sheet guiding unit facing the second side of the recording medium when the sheet guiding unit separating mechanism is moved to separate from the fixing nip, wherein the first and second sheet guiding elements together pivot around a first rotation fulcrum serving as a first rotation center to separate from the fixing nip after the second sheet guiding element is independently displaced in a direction substantially perpendicular to the conveying direction of the recording medium.

2. The sheet guiding unit separating mechanism as claimed in claim 1, wherein the first rotation fulcrum is disposed above the nip in a direction substantially perpendicular to the conveying direction of the recording medium, the sheet guiding unit separating mechanism further comprising:

a first bracket unit enabled to freely pivot around the first rotation fulcrum as a first rotation center, the first bracket unit having a given length extending substantially perpendicular to the sheet conveying direction of the recording medium from the first rotation fulcrum toward the sheet guiding unit facing the other side of the recording medium;

a second bracket unit to link the first rotation fulcrum to a second rotation fulcrum disposed beside the first rotation fulcrum in the conveying direction of the recording medium; and a third bracket unit enabled to freely pivot around the second rotation fulcrum, the third bracket unit having a given length extending substantially perpendicular to the sheet conveying direction of the recording medium from the second rotation fulcrum toward the sheet guiding unit facing the other side of the recording medium, wherein the first sheet guiding unit is provided at a pivoting leading end of the first bracket unit and the second sheet guiding unit is provided at a pivoting leading end of the third bracket unit.

3. The sheet guiding unit separating mechanism as claimed in claim 2, further comprising a biasing member to bias the second bracket unit in a first direction in which the sheet guiding unit separating mechanism pivots, the biasing member biasing the first bracket unit in a second direction opposite the first direction in which the sheet guiding unit separating mechanism pivots, wherein the biasing member positions the first bracket unit at a predetermined position.

4. The sheet guiding unit separating mechanism as claimed in claim 2, wherein the first and third bracket units comprise regulation members to regulate displacement of the third bracket unit to and from the first bracket unit in a direction substantially perpendicular to the conveying direction of the recording medium.

5. The sheet guiding unit separating mechanism as claimed in claim 2, further comprising an operation member externally manipulated to freely coaxially pivot around the second rotation fulcrum, the operation member including a locking member to lock the sheet guiding unit separating mechanism in an initial position of the sheet guiding unit separating mechanism taken before separating, wherein the sheet guiding unit separating mechanism is separated from the fixing nip by unlocking the locking member.

6. The sheet guiding unit separating mechanism as claimed in claim 1, further comprising an operation member externally manipulated to separate the sheet guiding unit separating mechanism from the fixing nip.

7. The sheet guiding unit separating mechanism as claimed in claim 1, wherein the first sheet guiding unit is placed beside one of the pair of opposed rotating members at a given interval therefrom, the first sheet guiding unit including a separating plate to peel off the recording medium from the one of the pair of opposed rotating members.

8. A fixing device comprising:

a housing: housing;

a pair of opposed rotating members to fix a unfixed toner image onto a recording medium by providing heat and pressure thereto in a fixing nip formed therebetween; and a sheet guiding unit separating mechanism disposed downstream of the fixing nip in a conveying direction in which the recording medium is conveyed, the sheet guiding unit separating mechanism including:

a pair of first and second sheet guiding units disposed facing first and second sides of the recording medium, respectively, to cooperatively guide the recording medium discharged from the fixing nip downstream, one of the pair of sheet guiding units facing the first side of the recording medium and including a first sheet guiding element disposed immediately downstream of the fixing nip and a second sheet guiding element disposed downstream of the first sheet guiding element, wherein the second sheet guiding element is displaceable in a direction substantially perpendicular to the conveying direction of the recording medium and separate from the sheet guiding unit facing the second side of the recording medium when the sheet guiding unit separating mechanism is moved to separate from the fixing nip, wherein the first and second sheet guiding elements together pivot around a first rotation fulcrum serving as a first rotation center to separate from the fixing nip after the second sheet guiding element is independently displaced in a direction substantially perpendicular to the conveying direction of the recording medium.

9. The fixing device as claimed in claim 8, wherein the first rotation fulcrum is disposed above the nip in a direction substantially perpendicular to the conveying direction of the recording medium, the sheet guiding unit separating mechanism further comprising:

a first bracket unit enabled to freely pivot around the first rotation fulcrum as a first rotation center, the first bracket unit having a given length extending substantially perpendicular to the sheet conveying direction of the recording medium from the first rotation fulcrum toward the sheet guiding unit facing the other side of the recording medium, the first bracket unit including the first sheet guiding unit at its pivoting leading end opposite the first rotation fulcrum;

a second bracket unit to link the first rotation fulcrum to a second rotation fulcrum disposed beside the first rotation fulcrum in the conveying direction of the recording medium; and a third bracket unit enabled to freely pivot around the second rotation fulcrum, the third bracket unit having a given length extending substantially perpendicular to the sheet conveying direction of the recording medium from the second rotation fulcrum toward the sheet guiding unit facing the other side of the recording medium, the third bracket unit including the second sheet guiding unit at its pivoting leading end opposite the second rotation fulcrum.

10. The fixing device as claimed in claim 9, further comprising a biasing member to bias the second bracket unit in a first direction in which the sheet guiding unit separating mechanism pivots, the biasing member biasing the first bracket unit in a second direction opposite the first direction in which the sheet guiding unit separating mechanism pivots, wherein the biasing member positions the first bracket unit at a predetermined position.

11. The fixing device as claimed in claim 9, wherein the first and third bracket units comprise regulation members to regulate displacement of the third bracket unit to and from the first bracket unit in a direction substantially perpendicular to the conveying direction of the recording medium.

12. The fixing device as claimed in claim 9, further comprising an operation member externally manipulated to freely coaxially pivot around the second rotation fulcrum, the operation member including a locking member to lock the sheet guiding unit separating mechanism in an initial position of the sheet guiding unit separating mechanism taken before separating, wherein the sheet guiding unit separating mechanism is separated from the fixing nip by unlocking the locking member.

13. The fixing device as claimed in claim 8, further comprising an operation member externally manipulated to separate the sheet guiding unit separating mechanism from the fixing nip.

14. The fixing device as claimed in claim 8, wherein the first sheet guiding unit is placed beside one of the pair of opposed rotating members at a given interval therefrom, the first sheet guiding unit including a separating plate to peel off the recording medium from the one of the pair of opposed rotating members.

15. An image forming apparatus comprising:

a housing;

an image forming unit to form a toner image; and a fixing device including: a housing; a pair of opposed rotating members to fix a unfixed toner image onto a recording medium by providing heat and pressure thereto in a fixing nip formed therebetween; and a sheet guiding unit separating mechanism disposed downstream of the fixing nip in a conveying direction in which the recording medium is conveyed, the sheet guiding unit separating mechanism including:

a pair of first and second sheet guiding units disposed facing first and second sides of the recording medium, respectively, to cooperatively guide the recording medium discharged from the fixing nip downstream, one of the pair of sheet guiding units facing the first side of the recording medium and including a first sheet guiding element disposed immediately downstream of the fixing nip and a second sheet guiding element disposed downstream of the first sheet guiding element, wherein the second sheet guiding element is displaceable in a direction substantially perpendicular to the conveying direction of the recording medium and separate from the sheet guiding unit facing the second side of the recording medium when the sheet guiding unit separating mechanism is moved to separate from the fixing nip, wherein the first and second sheet guiding elements together pivot around a first rotation fulcrum serving as a first rotation center to separate from the fixing nip after the second sheet guiding element is independently displaced in a direction substantially perpendicular to the conveying direction of the recording medium.

16. The image forming apparatus as claimed in claim 15, wherein the first rotation fulcrum is disposed above the nip in a direction substantially perpendicular to the conveying direction of the recording medium, the sheet guiding unit separating mechanism further comprising:

a first bracket unit enabled to freely pivot around the first rotation fulcrum as a first rotation center, the first bracket unit having a given length extending substantially perpendicular to the sheet conveying direction of the recording medium from the first rotation fulcrum toward the sheet guiding unit facing the other side of the recording medium, the first bracket unit including the first sheet guiding unit at its pivoting leading end opposite the first rotation fulcrum;

a second bracket unit to link the first rotation fulcrum to a second rotation fulcrum disposed beside the first rotation fulcrum in the conveying direction of the recording medium; and a third bracket unit enabled to freely pivot around the second rotation fulcrum, the third bracket unit having a given length extending substantially perpendicular to the sheet conveying direction of the recording medium from the second rotation fulcrum toward the sheet guiding unit facing the other side of the recording medium, the third bracket unit including the second sheet guiding unit at its pivoting leading end opposite the second rotation fulcrum.

17. The image forming apparatus as claimed in claim 16, further comprising:

a biasing member to bias the second bracket unit in a first direction in which the sheet guiding unit separating mechanism pivots, the biasing member biasing the first bracket unit in a second direction opposite the first direction in which the sheet guiding unit separating mechanism pivots; and an operation member externally manipulated to freely coaxially pivot around the second rotation fulcrum, the operation member including a locking member to lock the sheet guiding unit separating mechanism in an initial position of the sheet guiding unit separating mechanism taken before separating, wherein the biasing member positions the first bracket unit at a predetermined position, wherein the first and third bracket units comprise regulation members to regulate displacement of the third bracket unit to and from the first bracket unit in a direction substantially perpendicular to the conveying direction of the recording medium, wherein the sheet guiding unit separating mechanism is separated from the fixing nip by unlocking the locking member.

18. The image forming apparatus as claimed in claim 15, further comprising an operation member externally manipulated to separate the sheet guiding unit separating mechanism from the fixing nip.

19. The image forming apparatus as claimed in claim 15, wherein the first sheet guiding unit is placed beside one of the pair of opposed rotating members at a given interval therefrom, the first sheet guiding unit including a separating plate to peel off the recording medium from the one of the pair of opposed rotating members.

20. The image forming apparatus as claimed in claim 15, further comprising a downstream side sheet guiding unit disposed immediately downstream of the pair of sheet guiding units at a prescribed interval therefrom, wherein the fixing device and the downstream side sheet guiding unit are integrally detachable from the image forming apparatus.

* * * * *